United States Patent [19]

Barr

[11] 4,015,528

[45] Apr. 5, 1977

[54] HIGH DENSITY ARMOR PIERCING PROJECTILE

[75] Inventor: Irwin R. Barr, Lutherville, Md.

[73] Assignee: The United States of America as represented by the Secretary of the Air Force, Washington, D.C.

[22] Filed: Mar. 19, 1975

[21] Appl. No.: 559,860

[52] U.S. Cl. ..... 102/52; 102/92.2; 102/93

[51] Int. Cl.[2] ..... F42B 13/06

[58] Field of Search ..... 102/52, 93, 92.2

[56] References Cited

UNITED STATES PATENTS

| | | | |
|---|---|---|---|
| 3,302,570 | 2/1967 | Marquardt | 102/52 |
| 3,311,061 | 3/1967 | Roehrdanz | 102/93 |
| 3,348,485 | 10/1967 | Dufour | 102/52 |
| 3,516,323 | 6/1970 | O'Brien | 102/93 X |
| 3,795,196 | 3/1974 | Hillenbrand | 102/52 |
| 3,861,311 | 1/1975 | Bilsbury | 102/52 |

*Primary Examiner*—Verlin R. Pendegrass
*Attorney, Agent, or Firm*—Joseph E. Rusz; Jacob N. Erlich

[57] ABSTRACT

A high density armor piercing projectile having a cylindrically-shaped penetrator core. The core has a length substantially greater than the diameter thereof. Encompassing the penetrator is a carrier body and nose. The carrier body being press fit on the penetrator core and having a stabilizing ring press fit thereon. An obturator and pusher plate are secured to the rear of the penetrator core. In addition, the design of the carrier body enables the projectile to be spin stabilized when fired from any suitable weapon.

7 Claims, 1 Drawing Figure

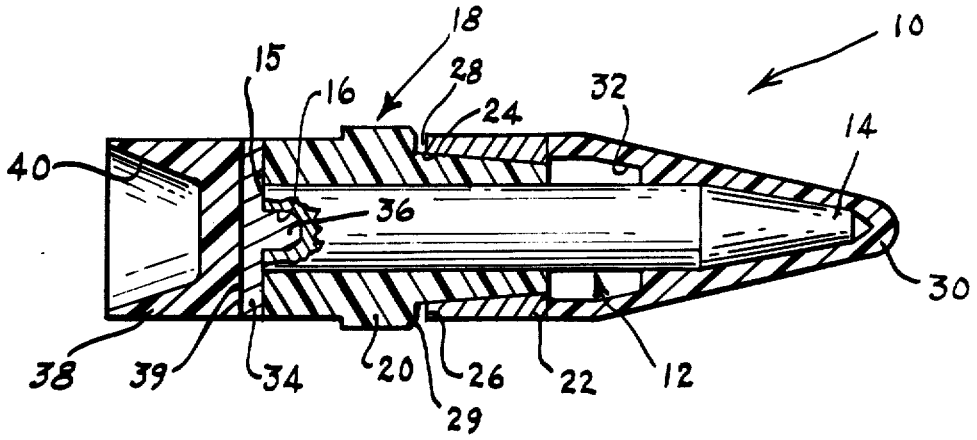
18
10
15
16
28
24
32
14
40
36
30
38
39
34
20
26
22
12
29

HIGH DENSITY ARMOR PIERCING PROJECTILE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to projectiles, and, more particularly to high density armor penetrating projectiles which incorporate therein heavy long penetrator cores.

The primary function of the armor piercing projectile is to penetrate the armor surrounding vulnerable components of, or personnel within intricate machines such as personnel carries, tanks and equivalent armored vehicles. Heretofore, this projectile design contained a hardened steel penetrator that was the full diameter of the projectile and substantially shorter than the projectile length in order to reduce weight so that initial launch velocity would be high, thus obtaining maximum penetrator energy. In order to increase damage at the target, some of the former projectiles contained, in addition to the penetrator, an incendiary material forward of the hardened steel penetrator. Because the projectile penetrator was large in diameter, a large amount of armor would have to be displaced to allow penetration. Thus the armor absorbed a large amount of the penetrating energy of the projectile and thinner armor could prevent passage of the projectile. Also by making the armor of a high hardness steel material, many such hardened steel projectiles would be shattered upon impact, reducing projectile penetration considerably.

The most efficient and effective armor penetrating projectiles should be assembled with extremely heavy long penetrator cores. However, aerodynamic stability requirements dictate that conventional metal encapsulated armor piercing projectiles as described hereinabove be assembled with heavy short (length to diameter) penetrator cores or lightweight long (length to diameter) penetrators. Heretofore, providing a heavy long penetrator core within an aerodynamic and spin stabilized projectile has been difficult to achieve.

SUMMARY OF THE INVENTION

The instant invention sets forth a high density armor piercing projectile which overcomes the problems set forth in detail hereinabove by providing within the projectile a penetrator core which is both heavy and long and comprises a large percentage of the total projectile weight. In addition, the projectile is designed to be spin stabilized when fired from a gun.

The projectile assembly of this invention is made up of a heavy, long penetrator core having a tapered front portion. A nylon carrier body is press fit onto the penetrator and formed to engage the rifle barrel. Such an arrangement transmits to the penetrator core by means of this press fit the rotational torque necessary for stabilizing purposes. A steel ring is designed to secure the press fit of the nylon carrier body onto the penetrator, thereby providing stability inertia. A nylon windshield or nose fits over the tapered portion of the penetrator core and enhances the aerodynamic qualities of the projectile.

Secured to the base of the core is a steel pusher which carries ballistic setback loads. Adhered thereto is an obturator gas seal which seals the ballistic gases. The entire armor piercing projectile of this invention is designed to remain integral when fired ballistically with the exception of the obturator which discards at the barrel exit.

It is therefore an object of this invention to provide a hign density armor piercing projectile which is spin stabilized and easily fired from a gun.

It is another object of this invention to provide a high density armor piercing projectile which contains therein a penetrator core which comprises a large percentage of the total projectile weight.

It is still another object of this invention to provide a high density armor piercing projectile which incorporates therein a heavy, long penetrator core.

It is still a further object of this invention to provide a method of manufacturing such a high density armor piercing projectile.

It is still a further object of this invention to provide a high density armor piercing projectile which is economical to produce and which utilizes conventional currently available components that lend themselves to standard, mass producing manufacturing techniques.

For a better understanding of the present invention together with other and further objects thereof reference is made to the following description taken in conjunction with the accompanying drawing and its scope will be pointed out in the appended claims.

DESCRIPTION OF THE DRAWING

The only FIGURE of the drawing is a side elevational view, shown partly in cross section, of the high density armor piercing projectile of this invention. DETAILED DESCRIPTION OF THE PREFERRED EMBODIMENT Reference is now made to the only Figure of the drawing which shows, partly in cross section, the high density armor piercing projectile 10 of this invention. Forming an essential element of projectile 10 is a long cylindrically-shaped penetrator core 12 of high density material such as depleted uranium. Penetrator core 12 has formed at one end thereof an extremely tapered nose portion 14 and at the other end a flat rear surface 15 having a centrally located indentation 16 therein. A carrier body 18 is secured about penetrator core 12 by way of a light press fit (approximately 0.001–0.002 inches interference). Carrier body 18 is mounted on core 12 having the rear portion thereof in alignment with the rear portion of penetrator core 12. Formed about the midpoint of carrier body 18 is an annular enlargement 20 which engages with a rifle bore (not shown) thereby imparting spin to projectile 10 as it passes along the rifle barrel bore. The front portion of carrier body 18 is of a slightly tapered or conical configuration so as to mate with a stability ring 22 in a manner to be described hereinbelow. It is preferable that carrier body 18 be manufactured from any suitable lightweight material such as glass-filled nylon.

A stability ring 22 made of any suitable high strength material such as steel is secured about the glass-filled nylon carrier body 18 along the frusto-conical intersection 24 thereof with a heavy press fit (approximately 0.003–0.004 inches interference) as seen from the Figure in the drawing. The interior configuration of stability ring 22 is of such a tapered or conical configuration so as to mate with the conical configuration of carrier body 18. It is essential that the rear end 26 of stability ring 22 be spaced slightly at 28 forward of the shoulder 29 formed on enlargement 20 of carrier body 18. Such a space 28 provides a set back clearance whereby upon the firing of projectile 10, steel stability ring 22 is driven rearward relative to carrier body 18 and thereby increases the press fit between ring 22 and carrier body 18. In this manner an additional aid in the retention of the carrier body 18 on the penetrator core 12 is accomplished.

Encompassing the tapered or nose of penetrator core 12 is a windshield or nose portion 30. Nose 30 is also of an extremely tapered or streamlined configuration and thereby enhances the aerodynamic qualities of projectile 10. Nose 30 is secured on penetrator 12 by a light press fit (approximately 0.001–0.002 inches interference) along the annular area of intersection thereof with the cylindrical nose section of penetrator core 12. Portions of nose 30 may have cutout portions 32 formed therein to decrease the weight of this portion of projectile 12. Any suitable lightweight material such as nylon may make up nose 30.

A steel pusher 34 is secured to the rear portion of penetrator core 12 by a light annular press fit (approximately 0.001–0.002 inches interference), between a forward nipple 36 formed thereon and the corresponding rear indentation 16 on penetrator core 12. A high density obturator 38 made of any suitable material such as polyethylene is secured to the steel pusher 34 by any suitable adhesive 39 such as conventional household cement. The rear portion of obturator 38 is of a concave configuration 40 and serves to minimize propellant gas blow-by and acts as the force transmission means to steel pusher 34 which in turn transmits a pushing force across the entire rear width of projectile 10.

Upon firing from any suitable gun, the obturator 38 is discarded at the barrel exit while the remaining portion of projectile 12 propels toward an armored target. Upon impact, nose 30 may shatter while the penetrator core 12 passes on through. In this manner an effective armor piercing projectile is produced.

Although this invention has been described with reference to a particular embodiment, it will be understood to those skilled in the art that this invention is also capable of a variety of alternate embodiments within the spirit and scope of the appended claims.

I claim:

1. A high density armor piercing projectile comprising a high density penetrator core, said penetrator core being of a length substantially greater than the width thereof and being tapered at one end thereof and having a substantially flat surface at the other end thereof, an indentation being formed within said flat surface of said penetrator core, a carrier body encompassing said penetrator core and having one end thereof located adjacent said flat surface of said core, the other end of said carrier body being of a conical configuration, an enlarged annular segment formed about the midpoint of said carrier body for engaging the barrel bore of a weapon, a stabilizing ring encompassing said conical end of said carrier body and being displaced a predetermined distance from the shoulder of said enlarged annular segment of said carrier body, a lightweight nose being mounted on said tapered end of said penetrator core and abutting at an end thereof said stabilizing ring, a flat pusher plate mounted against the rear flat surface of said penetrator core, said pusher plate having a nipple thereon, said nipple fitting within said indentation in said penetrator body and an obturator mounted on said pusher plate.

2. A high density armor piercing projectile as defined in claim 1 wherein said pusher plate is mounted across the entire rear width of said penetrator core and carrier body.

3. A high density armor piercing projectile as defined in claim 2 wherein said carrier body and said nose are press fit upon said penetrator core.

4. A high density armor piercing projectile as defined in claim 3 wherein said interior configuration of said stabilizing ring matingly corresponds with said conical end of said carrier body and being press fit thereon.

5. A high density armor piercing projectile as defined in claim 4 wherein said nipple of said pusher plate is press fit within said indentation within said rear of said penetrator core.

6. A high density armor piercing projectile as defined in claim 5 wherein said obturator is secured to said pusher plate by an adhesive.

7. A high density armor piercing projectile as defined in claim 6 wherein said penetrator core is of a cylindrical configuration and is made from depleted uranium.

* * * * *